US011175013B2

(12) United States Patent
Peng et al.

(10) Patent No.: US 11,175,013 B2
(45) Date of Patent: Nov. 16, 2021

(54) CEILING LIGHT APPARATUS

(71) Applicant: XIAMEN ECO LIGHTING CO. LTD., Xiamen (CN)

(72) Inventors: Wenjin Peng, Xiamen (CN); Shouqiang Hou, Xiamen (CN); Xiaoliang Wen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/879,761

(22) Filed: May 21, 2020

(65) Prior Publication Data

US 2021/0108781 A1 Apr. 15, 2021

(51) Int. Cl.

| | |
|---|---|
| ***F21V 7/00*** | (2006.01) |
| ***F21V 23/00*** | (2015.01) |
| ***F21V 13/04*** | (2006.01) |
| ***F21S 8/04*** | (2006.01) |
| ***F21V 23/04*** | (2006.01) |
| ***F21Y 105/18*** | (2016.01) |
| ***F21Y 115/10*** | (2016.01) |

(52) U.S. Cl.

CPC ..... *F21V 7/0025* (2013.01); *F21S 8/04* (2013.01); *F21V 7/0016* (2013.01); *F21V 13/04* (2013.01); *F21V 23/003* (2013.01); *F21V 23/04* (2013.01); *F21Y 2105/18* (2016.08); *F21Y 2115/10* (2016.08)

(58) Field of Classification Search

CPC .... F21V 7/0025; F21V 7/0016; F21V 23/003; F21V 23/04; F21S 8/04; F21S 8/046; F21Y 2105/18; F21Y 2115/10; F21Y 2103/33; F21Y 2113/13

See application file for complete search history.

(56) References Cited

U.S. PATENT DOCUMENTS

| | | | | |
|---|---|---|---|---|
| 7,229,199 | B2 * | 6/2007 | Lee | G02F 1/133602 362/240 |
| 8,840,269 | B2 * | 9/2014 | Kang | F21V 3/02 362/241 |
| 9,696,007 | B2 * | 7/2017 | Min | F21V 7/0025 |
| 2019/0162387 | A1 * | 5/2019 | Im | F21V 23/02 |
| 2019/0268991 | A1 * | 8/2019 | Li | F21V 23/003 |
| 2020/0073046 | A1 * | 3/2020 | Kim | G02B 6/0091 |

* cited by examiner

*Primary Examiner* — Peggy A Neils
(74) *Attorney, Agent, or Firm* — Chun-Ming Shih; Lanway IPR Services

(57) ABSTRACT

In some embodiments, a lighting apparatus includes a back cover, a first light source, a second light source, a back cover, a first separator and a driver. The first light source is mounted on the back cover. For example, the first light source includes multiple LED modules mounted on a circular ring structure. The circular ring structure is fixed to the back cover. Each LED module may have a LED chip covered by a lens module for guiding an output light of the LED chip to desired directions, e.g. to form a condensed light beam or to diffuse evenly on a projected surface.

18 Claims, 10 Drawing Sheets

CEILING LIGHT APPARATUS

FIELD

The present application is related to a lighting apparatus and more particularly related to a ceiling light apparatus.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

Ceiling light devices are popular and used in various places. It is beneficial to design a more convenient and flexible light devices.

SUMMARY

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

In some embodiments, a lighting apparatus includes a back cover, a first light source, a second light source, a back cover, a first separator and a driver.

The back cover has a fixing unit for fixing to an installation surface, e.g. a ceiling. In some embodiments, the back cover is made of metal material. For example, the back cover may be a metal plate with some holes as the fixing unit to be locked to the ceiling via screws, bolts or other buckle structures.

The back cover may be made of one-piece structure, or a multi-piece structure which may include multiple components assembled together as a module.

The first light source is mounted on the back cover. For example, the first light source includes multiple LED modules mounted on a circular ring structure. The circular ring structure is fixed to the back cover. Each LED module may have a LED chip covered by a lens module for guiding an output light of the LED chip to desired directions, e.g. to form a condensed light beam or to diffuse evenly on a projected surface.

Each LED chip may have more than one LED dies with different parameters. For example, each LED chip or each LED module may have two white LED chips with different color temperatures for mixing a desired color temperature. Different colors may be mixed by using multiple LED chips or dies with different colors, e.g. red, green, blue LED chips that emit lights of different colors originally or generate lights of different colors by covering corresponding fluorescent layers.

In some embodiments, the second light source is also mounted on the same back cover as the first light source.

In some other embodiments, the second light source is detachably attached and thus may be enclosed in a detachable module.

The first separator has a first side for reflecting a first light of the first light source to a first luminance area and having a second side for reflecting a second light of the second light source to a second luminance area. The first separator may be a one-piece component or may be a multi-piece component assembled together for providing the functions for guiding the first light to the first luminance area and for guiding the second light to the second luminance area.

The driver is used for controlling the first light source and the second light source separately to illuminate the first luminance area and the second luminance area separately. Specifically, the first light source and the second light source may be turned on or turned off separately, no need to be operated as the same manner at the same time.

In some embodiments, the driver may have multiple working modes. In some working modes, the first light source and the second light source are turned on and turned off at the same time. In some other working modes, the first light source may be turned on while the second light source is turned off. The intensity of the first light source may be increased while the intensity of the second light source may be decreased.

In some embodiments, more than 50% of light emitted from the second light source is reflected to the second luminance area. The second side of the separator may be attached or covered with a reflective material, e.g. white color, or mirror material, for efficiently reflecting light to the second luminance area.

In some embodiments, the second side may be the opposite side of the first side of the first separator. The first separator may be made of a light blocking material, so that the first light of the first light source does not pass through the first separator and the second light of the second light source does not pass through the second separator.

In some embodiments, the separator may also be made of heat dissipation material for carrying away heat when light of the second light source is emitted on the second side of the separator In some embodiments, the first light source includes multiple first LED modules. each LED module has a LED chip and a lens module covering the LED chip. The lens modules of the first light source distribute the first light emitted by the LED chips of the first light source evenly on the first luminance area.

In some embodiments, the lighting apparatus may also include a light passing cover. The first luminance area and the second luminance area are located on two different areas of the light passing cover.

In some embodiments, the first luminance area is located on a main area of the light passing cover facing to a ground when the installation surface is a ceiling. The second luminance area is located at a lateral wall of the light passing cover.

In some embodiments, the first separator is a separating wall with a top edge connecting to the light passing cover for dividing a container space defined by the back cover and the light passing cover into multiple separate light spaces.

In some embodiments, the light passing cover has a lens area covering the first light source for chaining light paths of the first light source.

In some embodiments, the first light of the first light source has a different color as the second light of the second light source.

In some embodiments, the driver controls the first light source and the second light source separately for emitting different mixed lights for different working modes.

In some embodiments, the driver controls the first light source and the second light source to provide similar appearances on the first luminance area and the second luminance area in one of the working modes.

In some embodiments, the lighting apparatus may also include a manual switch for a user to select one of the modes.

In some embodiments, the separator further has a separating unit for separating the first luminance area into multiple first sub-areas corresponding subsets of the first light source.

In some embodiments, the separator unit includes a cross structure with two opposite edges connecting to a light passing cover and the back cover respectively to enhance rigidity of the lighting apparatus.

In some embodiments, the first luminance area has a central area. A portion of the first light source emits a light beam via the central area.

In some embodiments, the lighting apparatus may also include a third light source and a second separator, wherein the second separator separates a third light of the third light source from the first light and the second light for the third light being emitted on a third luminance area.

In some embodiments, the first light source includes multiple first LED modules distributed as a first ring, the second light source includes multiple second LED modules distributed as a second ring, the second ring surrounds the first ring.

In some embodiments, the driver automatically detects whether the second light source exists and switches to a working mode supplying power to the second light source automatically. When the driver fails to detect the second light source, the driver skips generating a driving current to a second light source.

In some embodiments, the second light source is detachably attached to an electrode for receiving a driving current from the driver to emit the second light on the second luminance area.

In some embodiments, the second light source is enclosed in an external light passing cover attached to a light passing cover enclosing the first light source.

In some embodiments, the driver is mounted on a central area of the back cover.

DETAILED DESCRIPTION

Reference may now be made in detail to particular embodiments of the disclosure, examples of which are illustrated in the accompanying drawings. While the disclosure may be described in conjunction with the preferred embodiments, it may be understood that they may not intended to the limit the disclosure to these embodiments. On the contrary, the invention is intended to cover alternatives, modifications and equivalents that may be included within the spirit and scope of the disclosure as defined by the appended claims. Furthermore, in the following detailed description of the present disclosure, numerous specific details are set forth in order provide a thorough understanding of the present disclosure. However, it may be readily apparent to one skilled in the art that the present disclosure may be practiced without these specific details. In other instances, well-known methods, procedures, processes, components, structures, and circuits have not been described in detail so as not to unnecessarily obscure aspects of the present invention.

Figure 1:
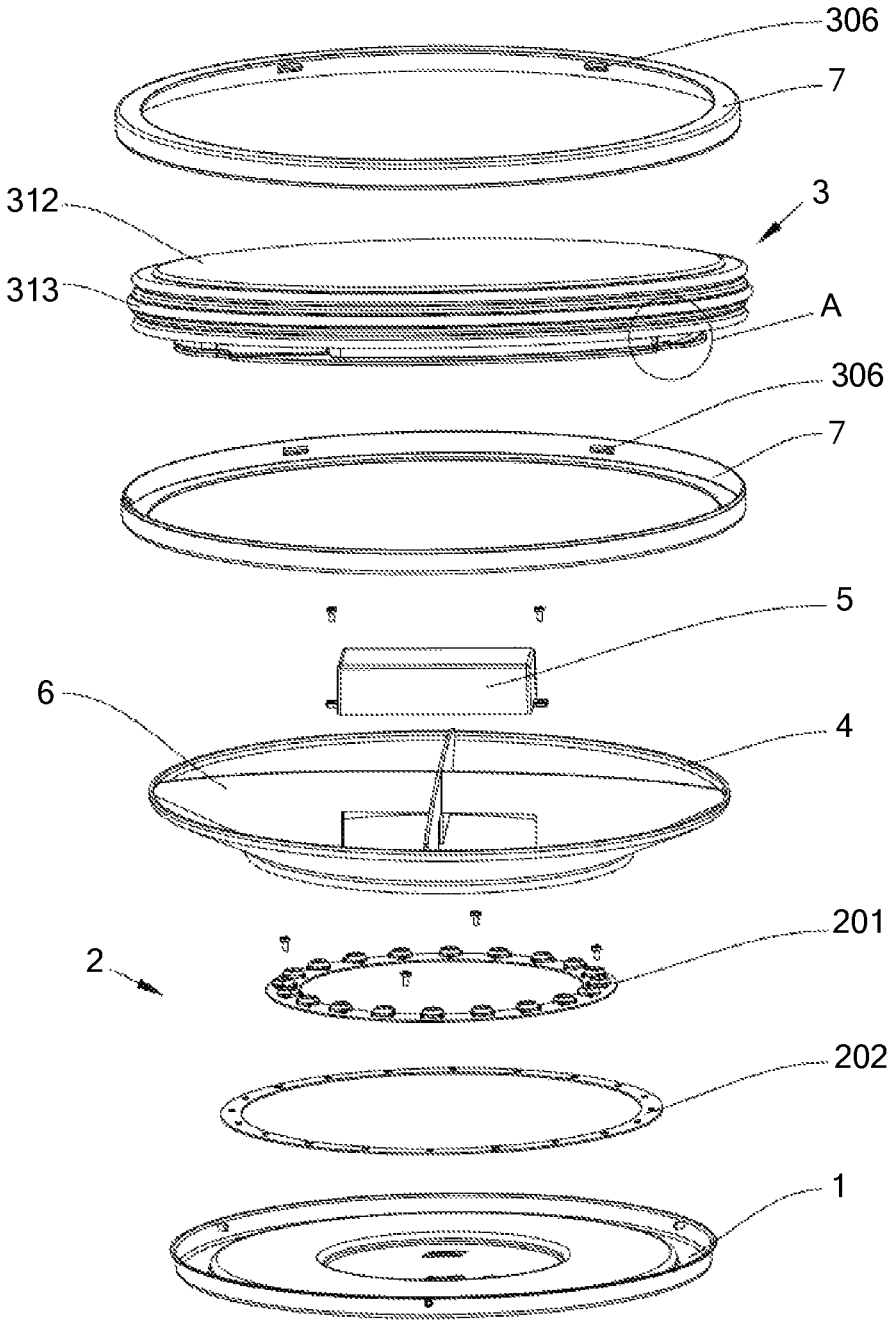
FIG. 1 illustrates an exploded view of a ceiling light apparatus.
Figure 2:
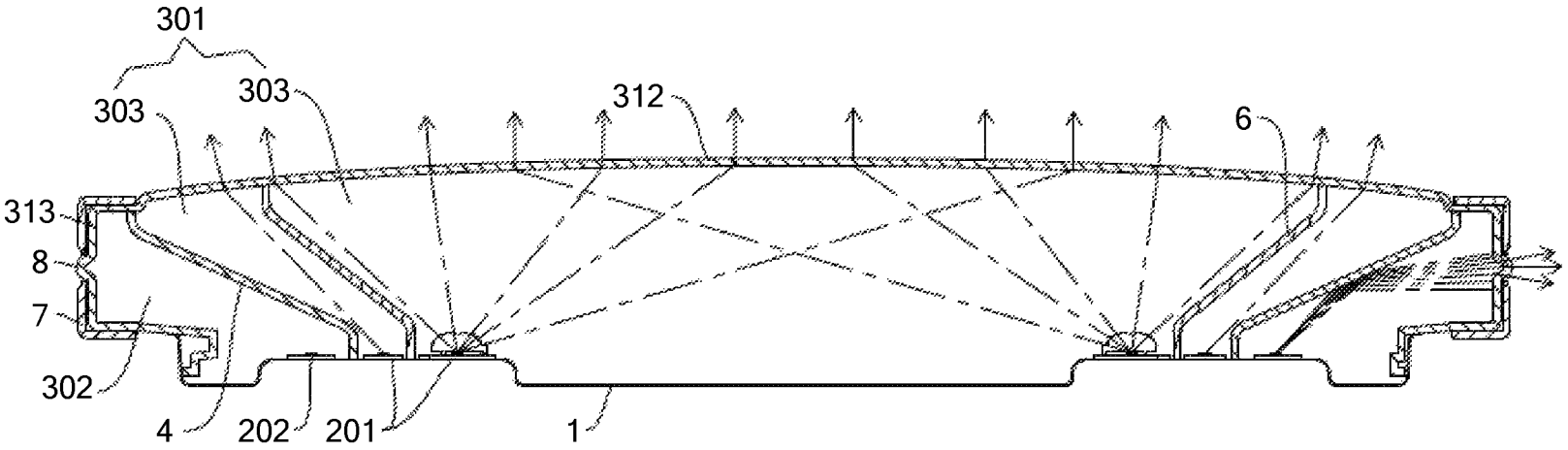
FIG. 2 illustrates light paths of the example in FIG. 1.

Please refer to FIG. 1 and FIG. 2, which illustrate an embodiment of a ceiling light. The ceiling light apparatus includes a back cover 1, a light passing cover 3, a ring-shape separator 4 as a first separator example mentioned below, a first separator plate 6 as a separator unit example mentioned below, multiple light sources 2 including a first light source and a second light source, and a driver 5.

In an embodiment, the light passing cover 3 is connected to the back cover 1. The light passing cover 3 and the back cover 1 together form a luminance container. The ring-shape separator 4 is installed inside the light passing cover 3 for dividing the luminance container as a first luminance area 301 and a second luminance area 302.

The first luminance area 301 and the second luminance area 302 are respectively located at a first side and a second side of the ring-shape separator 4. The first separator unit 6 is located inside the ring-shape separator 4 for dividing the first luminance area 301 into multiple separate first sub-areas 303.

The multiple light sources 2, including a first light source and a second light source, are respectively disposed in the first luminance area 303 and the second luminance area 302.

The driver 5 is disposed on the back cover 1. The driver 5 is connected to the multiple light sources 2 for controlling the first light source and the second light source separately to illuminate the first luminance sub-area 303 and the second luminance area 302 separately.

In some embodiments, the driver 5 converts an indoor power source, like a 110V/220V alternating current power source to a low voltage level direct current power source as driving powers supplied to the light sources 2.

In some other embodiments, the driver 5 transmits control signals to turn on, to turn off, or to adjust parameters of the light sources 2. The first light source and the second light source may include multiple subsets of LED modules that can be operated and controlled separately.

With such design, the ceiling light embodiment may generate multiple light patterns by controlling the driver with a wall switch, a remote control via a wireless protocol, a stored schedule with predetermined control settings or respond to a sensor. For example, when the driver uses a sensor detecting that no one is nearby, the driver controls the ceiling light to enter an energy saving mode, e.g. only turning on the second luminance area.

Specifically, the first luminance area 301 may be turned on, turned off, adjusted with different parameters like color temperatures or colors, while the second luminance area 302 may be turned on, turned off, adjusted with different parameters like color temperatures or colors separately.

In addition, even the first luminance area or the second luminance area may be divided into multiple sub-areas to be controlled separately to generate even more light patterns.

Such design enriches light appearances of the ceiling light apparatus, adding values to the ceiling light apparatus.

In some embodiments, the back cover 1 is fixed to a ceiling with screws. There are elongated circular holes disposed on the back cover 1 for fixing to screws.

There are multiple elongated circular holes evenly distributed on the back cover 1 to provide a stable installation.

The first side and the second side of the ring-shape separator 4 are reflection surfaces. For example, reflective materials may be applied or attached on the first side and the second side of the ring-shape separator 4. A portion of light emitted from the light sources 2 is directly emitting to the light passing cover 3. Some other portion of the light emitted from the light sources 2 is reflected by the ring-shape separator and then directed to the first luminance area or the second luminance area on the light passing cover.

In some embodiments, the reflective surface of the ring-shape separator 4 has a curve surface to ensure reflected light more even.

The ring-shape separator 4 may be made of light blocking plastic plate. In some embodiments, the ring-shape separator 4 may be added or made of heat dissipation material like metal, metal wrapped with plastic, or plastic material with high heat dissipation ratio.

Aluminum reflective plate with mirror function may also be used for making the ring-shape separator 4 to increase reflection ratio.

Top edges of the ring-shape separator 4 may be attached to the light passing cover 3, e.g. by glue. In some other embodiments, the ring-shape separator 4 and the light passing cover 3 may be made together at the same as a one-piece component.

In some embodiments, the light passing cover 3 may have positioning or installation grooves for inserting top ends of the ring-shape separator 4. The bottom edges of the ring-shape separator 4 may be attached to the cover. The ring-shape separator 3 in such manner, may enhance structural strength. The separator unit like the cross structure separator unit disposed inside the ring-shape separator 4 in the drawings may further enhance the structural strength.

In some embodiments, the light sources 2 and the driver module 5 are installed on the back cover 5 first as a module. The back cover 5 is fixed to the ceiling first.

The light passing cover 3 and the ring-shape separator 4 are made or assembled as a module, which is then installed to the back cover to complete installation of the ceiling light apparatus.

The driver 5 may be controlled manually by a touch switch. By touching or pressing an operation surface of the ceiling light apparatus, the driver 5 is controlled to change color temperatures, colors, working modes or other parameters of the light sources.

Color temperature can be found in visible light. Color temperature describes the appearance of light provided by light source. Conventionally, the measure of color temperature is Kelvins. Cool colors, or bluish colors, have color temperature over 5000K, while warm colors, which are yellowish, are between 2700K to 3000K. Color temperature provides a standard for the comparison of light sources.

Color temperature is a physical quantity used in lighting optics for defining the color of the light source. The color temperature is defined as follows: heating a black-body to a certain temperature, when the color of the emitted light is the same as the color of the light emitted by a light source, the temperature of the black-body heating is called the color temperature of the light source, color temperature for short. The unit is expressed in "K" (Kelvin temperature unit). For general people, a low color temperature light source is usually called warm color, generally appeared as red, yellow or orange. A high color temperature light source is usually called cold color, generally appeared as blue or purple. The color temperature of some common light source, for example, standard candle is 1930K (Kelvin temperature unit); tungsten wire is 2760-2900K; fluorescent lamp is 6400K; flash is 3800K; noon sun is 5000K; electronic flash is 6000K; blue sky is 10000K.

Audio control with audio recognition circuit embedded in the driver 5, infrared control or other control methods may be added to the ceiling light embodiment.

In FIG. 1 and FIG. 2, the first separator unit 6 is a cross-shape separator. Other shapes may be used based on different requirements.

More than one first separator units 6 may be disposed for providing more separating luminance sub-areas corresponding to LED modules with multiple optical parameters, e.g. different color temperatures.

In some embodiments, the first luminance area 301 is divided into four sub-areas of sector shapes. There is an escape groove for placing the driver 5, which may be corresponding to the profile of the driver 5 to prevent light passing through the first separator unit 6.

Figure 3:
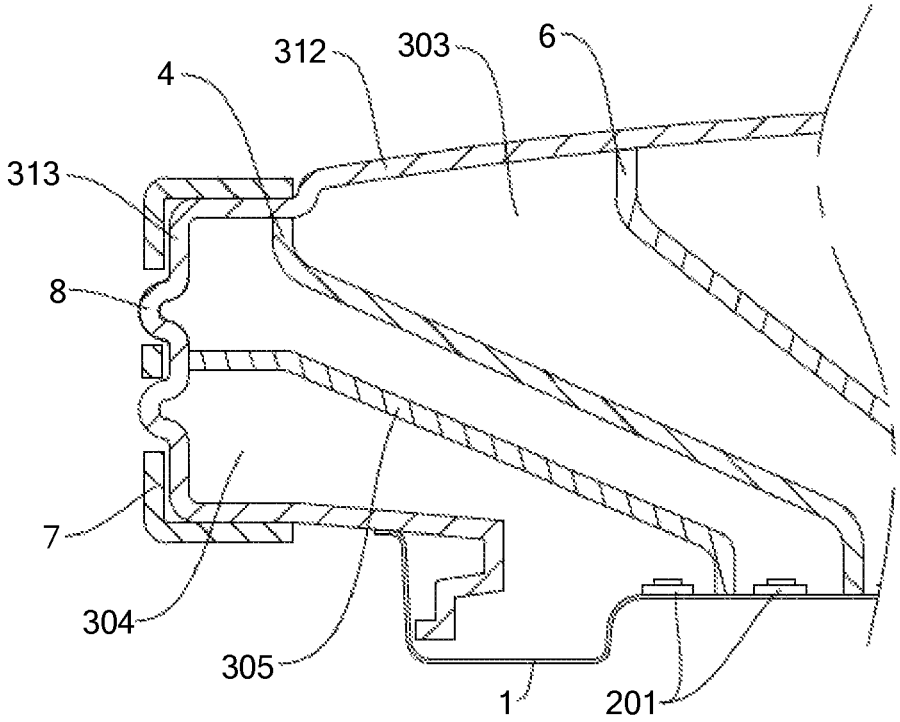
FIG. 3 illustrates a portion zoom-up view of another example.

In FIG. 2 and FIG. 3, the light passing cover 3 has a main area, as a first housing part 312, as the first luminance area 301 and has a lateral wall, as a second housing part 313, as the second luminance area 302. The first housing part 312 and the second housing part 313 may be a one-piece component, or two components assembled together.

When the first housing part 312 and the second housing part 313 are two pieces, the first housing part 312 and the second housing part 313 may be fixed together with glue.

The ring-shape separator 4 divides the light sources 2 into a first light source 201 and a second light source 202. The first light source 201 emits a first light to the first luminance area and the second light source 202 emits a second light to the second luminance area.

Please refer to FIG. 3. The second luminance area 302 may further include a second separator 305 for providing a third luminance area 304. There are light sources 2 for each luminance area that may be controlled separately and independently to create more light effects.

There are multiple light passing segments 8 corresponding to the second luminance area 304. The second separator 305 further divides the lateral luminance area into multiple lateral luminance areas.

By turning on and turning off light sources 2 in different luminance areas 304, the light patterns may be varied by such design.

Figure 4:
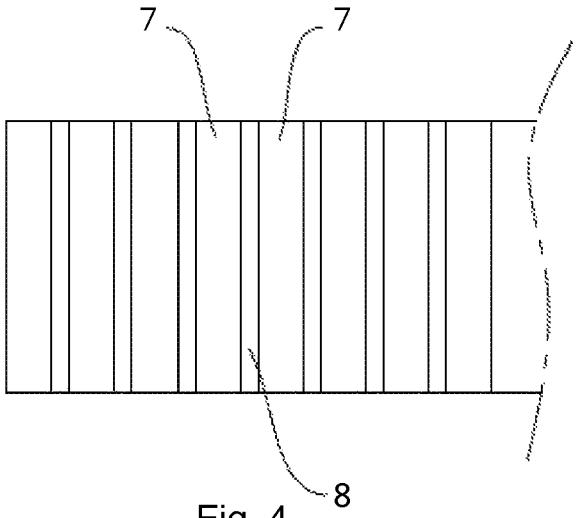
FIG. 4 illustrates luminance areas spaced with gaps.
Figure 5:
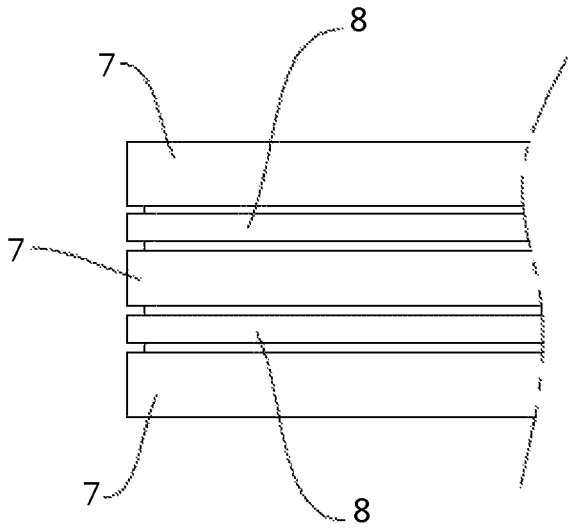
FIG. 5 illustrates another way to arrange luminance areas.

In FIG. 4, the lateral luminance area may be distributed as a circumferential distribution. Multiple luminance areas may be disposed separately forming multiple light bands on the lateral side along an axial direction of the light passing cover.

In some embodiments, ring shapes of luminance areas may be disposed.

In FIG. 2 to FIG. 6, the second housing part 313 has multiple decoration rings 7. The decoration rings 7 are disposed between two adjacent luminance areas 8.

The decoration rings 7 provides decoration for the ceiling light apparatus and also prevents lights of adjacent luminance areas to mix together to affect light output effect.

In FIG. 3, the light passing portion 8 has a convex structure. The light via the second housing 313 is passing through the convex structure with a condensing effect to increase light effect.

Figure 6:
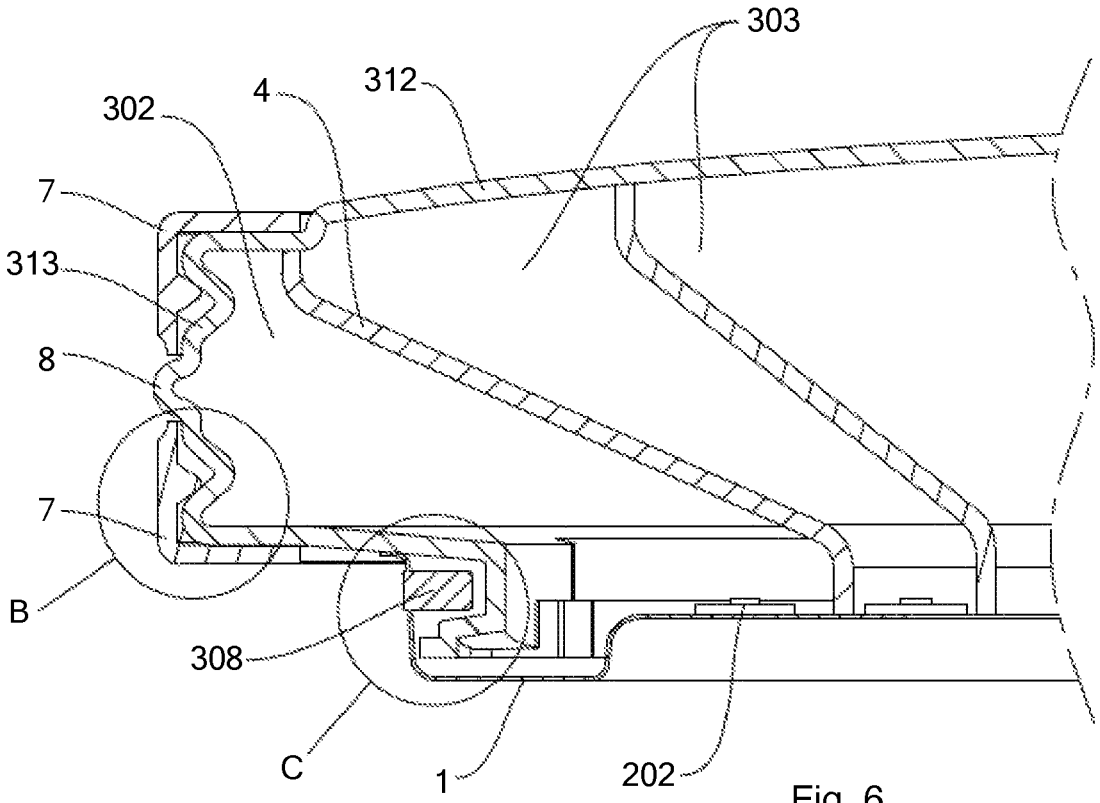
FIG. 6 illustrates component arrangement in another embodiment.
Figure 7:
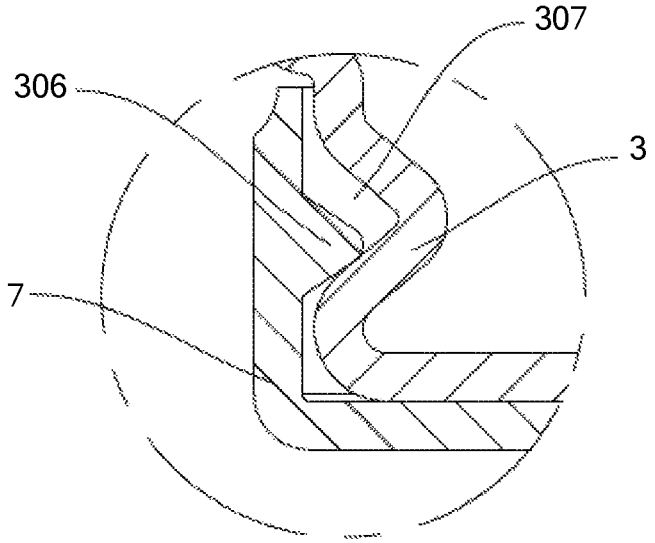
FIG. 7 illustrates a zoom-up view of a section in an example.

Please refer to FIG. 1, FIG. 6 and FIG. 7. The decoration ring 7 is fixed, e.g. to buckle with, the second housing part 31. The inner wall of the decoration ring 7 has a first buckle structure 306. The second housing part 31 has a buckle groove 307 corresponding to the buckle structure 306.

The decoration ring 7 and the second housing part 313 use buckle structure, with no need for screws to decrease components and simplify assembly process, which may lower the manufacturing cost at the same time.

There may be three buckle structures 306 distributed on an inner wall of the decoration ring 7.

The buckle structure 306 may be made as a one-piece structure as the decoration ring 7, which may increase structure strength.

The first buckle groove 307 may be a ring groove and has a cross profile as a V-shape. It is easy to install the two components by rotation without need to align the components. Other fixing methods may be used, e.g. using fasteners, glue, laser soldering or molding to fix the decoration ring 7 to the second housing part 313.

In FIG. 6, the light passing cover 3 is fixed to the back cover via rotation. The rotation buckle structure as illustrated is simple and easy to be operated.

Figure 8:
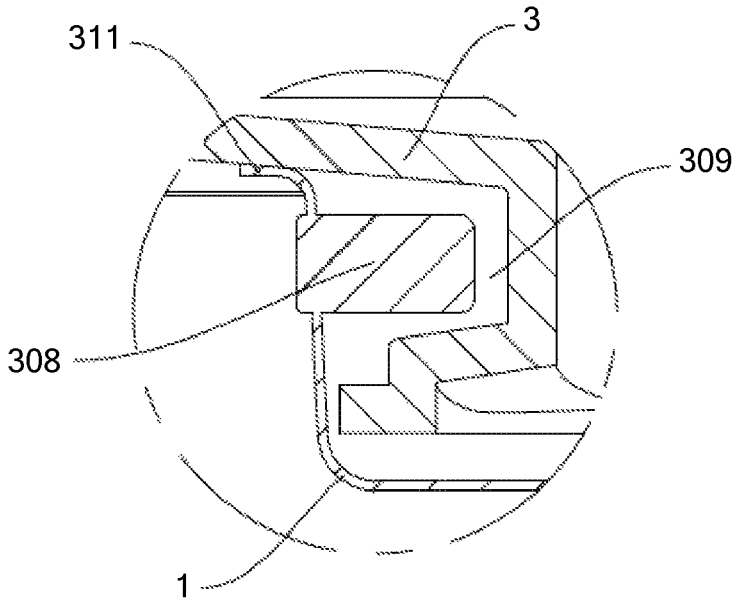
FIG. 8 illustrates a zoom-up view of another section in an example.
Figure 9:
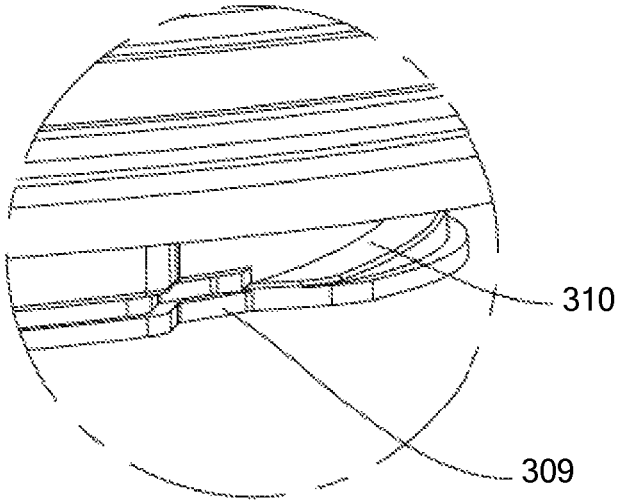
FIG. 9 illustrates a connection structure.

In FIG. 6, FIG. 8 and FIG. 9, the rotation buckle structure includes a second buckle structure 308, an escape groove 309 and a second buckle groove 301. The second buckle structure 308 is disposed at an inner wall of the back cover 1. The escape groove 309 is disposed on the light passing cover 3 and disposed along the light passing cover 3 in axial direction for escaping the second buckle structure 308.

The second buckle groove 301 is disposed on the light passing cover 3 disposed in circumferential direction of the light passing cover 3 and connected to the escape groove 309 to be buckled with the second buckle structure 308.

In some embodiments, the second buckle structure 308 has a cylinder column structure formed as a one-piece component to an inner wall of the back cover 1. The second buckle structure 308 may be a separate structure from the back cover 1, and fixed to the back cover 1 by screws or glue.

There may be multiple second buckle structures 308 disposed in circumferential direction of the back cover 1. The escape grooves 309 and the second buckle grooves 310 have the same number as the second buckle structures 308.

When installing the light passing cover 3 to the base cover 1, the escape groove 309 is aligned with the second buckle structure 308 and the light passing cover 3 is rotated with respect to the back cover 1 so that the second buckle structure 308 passes by the second buckle groove 309 and then is buckled with the second buckle groove 310 to fix the light passing cover 3 to the back cover 1.

In FIG. 9, the second buckle groove 310 has a cross-section profile diameter gradually decreasing away from the escape groove 309. When the second buckle structure 308 rotates into the second buckle groove 310 along the circumferential direction, the second buckle structure 308 has a larger force to the second buckle groove 310 because the cross-section diameter of the second buckle groove is decreased. Such design enhances connection reliability and safety of the connection between the light passing cover 3 and the base cover 1.

In FIG. 6, FIG. 8 and FIG. 9, the bottom end of the back cover 1 has a limiter 311 engaging the light passing cover 3. By engaging the limiter 311 to the light passing cover 3, the sealing between the back cover 1 and the light passing cover 3 is enhanced, to block light passing through and also ensures clean inner space of the ceiling light embodiment.

Figure 10:
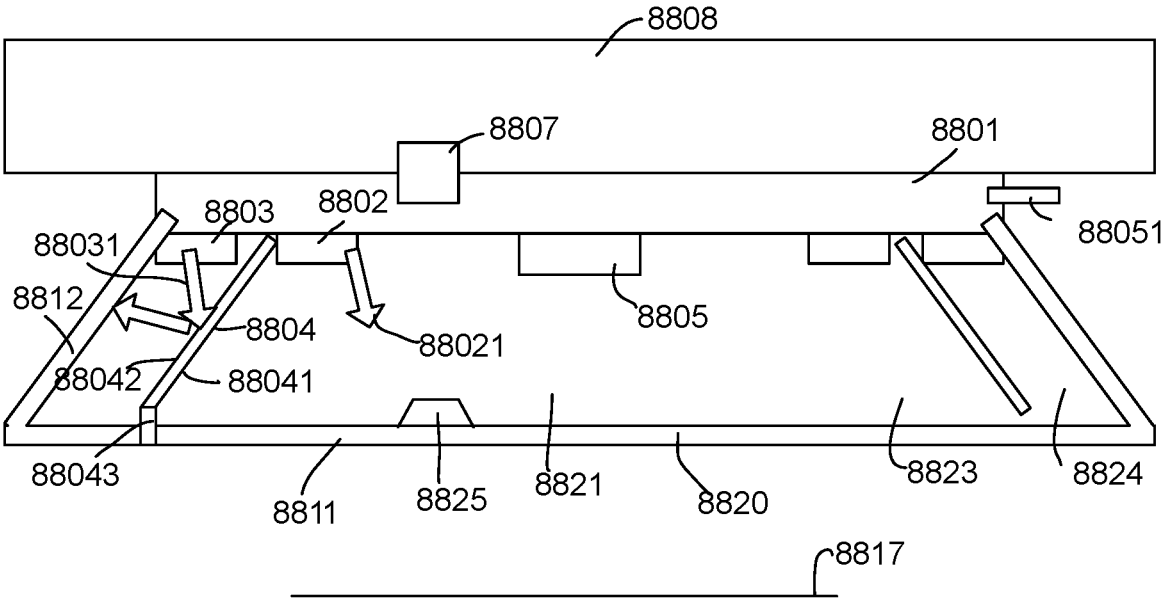
FIG. 10 illustrates a structure view of an embodiment.

In FIG. 10, a lighting apparatus includes a back cover 8801, a first light source 8802, a second light source 8803, a first separator 8804 and a driver 8805.

The back covert 8801 has a fixing unit 8807 for fixing to an installation surface 8808, e.g. a ceiling. In some embodiments, the back cover 8801 is made of metal material. For example, the back cover 8801 may be a metal plate with some holes as the fixing unit 8807 to be locked to the ceiling via screws, bolts or other buckle structures.

The back cover 8801 may be made of one-piece structure, or a multi-piece structure which may include multiple components assembled together as a module.

The first light source 8802 is mounted on the back cover 8801. For example, the first light source 8801 includes multiple LED modules mounted on a circular ring structure, which example may be found in FIG. 1. The circular ring structure is fixed to the back cover 8801.

Figure 11:
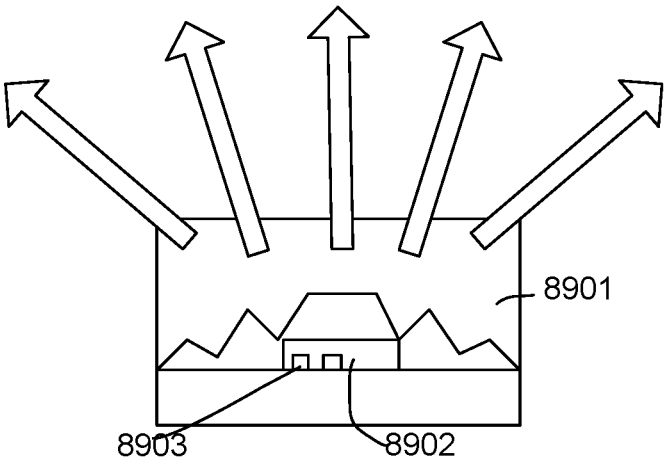
FIG. 11 shows a LED module example.

In FIG. 11, each LED module may have a LED chip 8902 covered by a lens module 8901 for guiding an output light of the LED chip 8902 to desired directions, e.g. to form a condensed light beam or to diffuse evenly on a projected surface. In such lens module, the light is guided to desired distribution, without using expensing light guide components.

Lens refers to an optical device refracting light sources. Through lens, the original light beam can be focused or dispersed. The first lens can be found before AD. In 13th century, lens was firstly used in commercial settings in Europe. Lens is made of glass or plastic. Lens can be molded to any desired shapes. Normally, both surfaces of a lens are spherical. To create more effects, planer, concave, or convex are also possible shapes for the surfaces. According to the curvature of the surfaces, lens can be divided into six categories: biconcave, biconvex, Plano-concave, plano-convex, negative meniscus, and positive meniscus. Other types of lens include Fresnel, lenticular, axicon, cylindrical, and gradient index.

Each LED chip may have more than one LED dies with different parameters. For example, each LED chip or each LED module may have two white LED chips with different color temperatures for mixing a desired color temperature. Different colors may be mixed by using multiple LED chips or dies with different colors, e.g. red, green, blue LED chips that emit lights of different colors originally or generate lights of different colors by covering corresponding fluorescent layers.

In some embodiments, the second light source is also mounted on the same back cover as the first light source.

In some other embodiments, the second light source is detachably attached and thus may be enclosed in a detachable module.

In FIG. 10, the first separator 8804 has a first side 88041 for reflecting a first light 88021 of the first light source 8802 to a first luminance area 8811 and having a second side 88042 for reflecting a second light 88031 of the second light source 8803 to a second luminance area 8812. The first separator 8804 may be a one-piece component or may be a multi-piece component assembled together for providing the functions for guiding the first light 88021 to the first luminance area 8811 and for guiding the second light 88031 to the second luminance area 8812.

The driver 8805 is used for controlling the first light source 8802 and the second light source 8803 separately to illuminate the first luminance area 8811 and the second luminance area 8812 separately. Specifically, the first light source 8802 and the second light source 8803 may be turned on or turned off separately, no need to be operated as the same manner at the same time.

In some embodiments, the driver 8805 may have multiple working modes. In some working modes, the first light source 8802 and the second light source 8803 are turned on and turned off at the same time. In some other working modes, the first light source 8802 may be turned on while the second light source 8803 is turned off. The intensity of the first light source 8802 may be increased while the intensity of the second light source 8803 may be decreased.

In some embodiments, more than 50% of light emitted from the second light source is reflected to the second luminance area. The second side of the separator may be attached or covered with a reflective material, e.g. white color, or mirror material, for efficiently reflecting light to the second luminance area.

In some embodiments, the second side may be the opposite side of the first side of the first separator. The first separator may be made of a light blocking material, so that the first light of the first light source does not pass through the first separator and the second light of the second light source does not pass through the second separator.

In some embodiments, the separator may also be made of heat dissipation material for carrying away heat when light of the second light source is emitted on the second side of the separator In FIG. 11, the first light source or the second light source includes multiple first LED modules 8902. Each LED module 8903 has a LED chip and a lens module covering the LED chip. The lens modules 8901 of the first light source distribute the first light emitted by the LED chips of the first light source evenly on the first luminance area.

In FIG. 10, the lighting apparatus may also include a light passing cover 8820. The first luminance area 8811 and the second luminance area 8812 are located on two different areas of the light passing cover 8820.

In some embodiments, the first luminance area 8811 is located on a main area of the light passing cover 8820 facing to a ground 8817 when the installation surface 8808 is a ceiling. The second luminance area 8812 is located at a lateral wall of the light passing cover 8820.

In FIG. 10, the first separator is a separating wall with a top edge 88043 connecting to the light passing cover 8820 for dividing a container space 8821 defined by the back cover 8801 and the light passing cover 8820 into multiple separate light spaces 8823, 8824.

In FIG. 10, the light passing cover has a lens area 8825 covering the first light source for changing light paths of the first light source.

In some embodiments, the first light of the first light source has a different color as the second light of the second light source.

In some embodiments, the driver controls the first light source and the second light source separately for emitting different mixed lights for different working modes.

In some embodiments, the driver controls the first light source and the second light source to provide similar appearances on the first luminance area and the second luminance area in one of the working modes.

In FIG. 10, the lighting apparatus may also include a manual switch 88051 for a user to select one of the modes.

In some embodiments, the separator further has a separating unit, as illustrated as the first separator unit 4 in FIG. 1, for separating the first luminance area into multiple first sub-areas corresponding subsets of the first light source.

In some embodiments, the separator unit includes a cross structure with two opposite edges connecting to a light passing cover and the back cover respectively to enhance rigidity of the lighting apparatus. The example in FIG. 1 also shows such an example.

Figure 12:
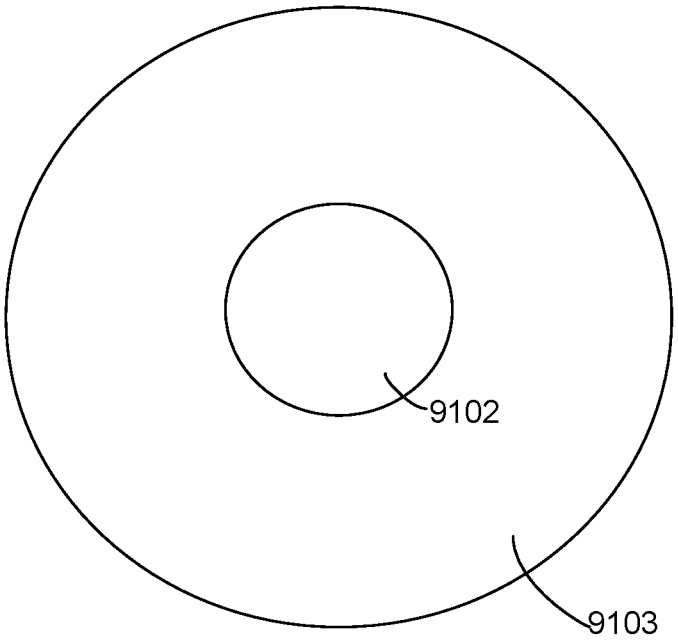
FIG. 12 shows a central luminance area.

In FIG. 12, the first luminance area 9103 has a central area 9102. A portion of the first light source emits a light beam via the central area 9102.

In some embodiments, the lighting apparatus may also include a third light source and a second separator, wherein the second separator separates a third light of the third light source from the first light and the second light for the third light being emitted on a third luminance area. This has an example illustrated in FIG. 3.

In some embodiments, the first light source includes multiple first LED modules distributed as a first ring, the second light source includes multiple second LED modules distributed as a second ring, the second ring surrounds the first ring. This has an example illustrated in FIG. 1.

In some embodiments, the driver automatically detects whether the second light source exists and switches to a working mode supplying power to the second light source automatically. When the driver fails to detect the second light source, the driver skips generating a driving current.

Figure 13:
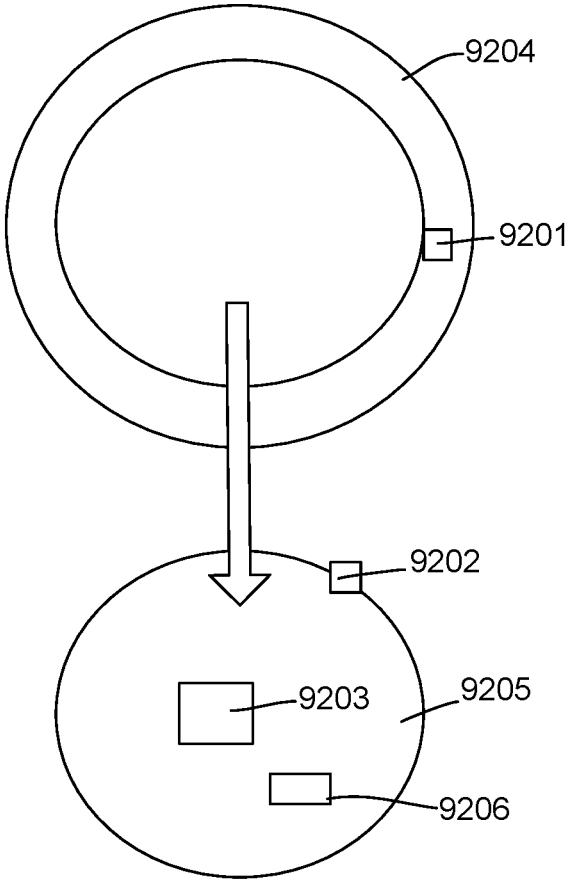
FIG. 13 shows a detachable module example.

In FIG. 13, the second light source 9201 is detachably attached to an electrode 9202 for receiving a driving current from the driver 9203 to emit the second light on the second luminance area.

In FIG. 13, the second light source 9201 is enclosed in an external light passing cover 9204 attached to a light passing cover 9205 enclosing the first light source 9206.

In some embodiments, the driver is mounted on a central area of the back cover. This is illustrated in FIG. 10.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a back cover with a fixing unit for fixing to an installation surface;

a first light source mounted on the back cover;

a second light source;

a first separator having a first side for reflecting a first light of the first light source to a first luminance area and having a second side for reflecting a second light of the second light source to a second luminance area, wherein the first luminance area is below;

a light passing cover, the first luminance area and the second luminance area are located on two different areas of the light passing cover, wherein the first luminance area is located on a main area of the light passing cover facing to a ground when the installation surface is a ceiling, the second luminance area is located at a lateral wall of the light passing cover; and a driver for controlling the first light source and the second light source separately to illuminate the first luminance area and the second luminance area separately.

2. The lighting apparatus of claim 1, wherein more than 50% of light emitted from the second light source is reflected to the second luminance area.

3. The lighting apparatus of claim 1, wherein the first light source comprises multiple first LED modules, each LED module has a LED chip and a lens module covering the LED chip, the lens modules of the first light source distribute the first light emitted by the LED chips of the first light source evenly on the first luminance area.

4. The lighting apparatus of claim 1, wherein the first separator is a separating wall with a top edge connecting to the light passing cover for dividing a container space defined by the back cover and the light passing cover into multiple separate light spaces.

5. The lighting apparatus of claim 4, wherein the light passing cover has a lens area covering the first light source for changing light paths of the first light source.

6. The lighting apparatus of claim 1, wherein the first light of the first light source has a different color as the second light of the second light source.

7. The lighting apparatus of claim 1, wherein the driver controls the first light source and the second light source separately for emitting different mixed lights for different working modes.

8. The lighting apparatus of claim 7, wherein the driver controls the first light source and the second light source to provide similar appearances on the first luminance area and the second luminance area in one of the working modes.

9. The lighting apparatus of claim 7, further comprising a manual switch for a user to select one of the modes.

10. The lighting apparatus of claim 1, wherein the separator further has a separating unit for separating the first luminance area into multiple first sub-areas corresponding subsets of the first light source.

11. The lighting apparatus of claim 10, wherein the separator unit comprises a cross structure with two opposite edges connecting to a light passing cover and the back cover respectively to enhance rigidity of the lighting apparatus.

12. The lighting apparatus of claim 10, wherein the first luminance area has a central area, a portion of the first light source emits a light beam via the central area.

13. The lighting apparatus of claim 1, further comprising a third light source and a second separator, wherein the second separator separates a third light of the third light source from the first light and the second light for the third light being emitted on a third luminance area.

14. The lighting apparatus of claim 1, wherein the first light source comprises multiple first LED modules distributed as a first ring, the second light source comprises multiple second LED modules distributed as a second ring, the second ring surrounds the first ring.

15. The lighting apparatus of claim 1, wherein the driver automatically detects whether the second light source exists and switches to a working mode supplying power to the second light source automatically, when the driver fails to detect the second light source, the driver skips generating a driving current for the second light source.

16. The lighting apparatus of claim 15, wherein the second light source is detachably attached to an electrode for receiving a driving current from the driver to emit the second light on the second luminance area.

17. The lighting apparatus of claim 16, wherein the second light source is enclosed in an external light passing cover attached to a light passing cover enclosing the first light source.

18. The lighting apparatus of claim 1, wherein the driver is mounted on a central area of the back cover.

* * * * *